US005610878A

United States Patent [19]

Pretat et al.

[11] Patent Number: 5,610,878

[45] Date of Patent: Mar. 11, 1997

[54] DESICCATION CAPSULE AND ARTICLE PROVIDED WITH SAID CAPSULE

[75] Inventors: Roland Pretat, Coeuve; Nadia De Boni, Porrentruy, both of Switzerland

[73] Assignee: Pont Saint-Germain SA, Porrentruy, Switzerland

[21] Appl. No.: 567,906

[22] Filed: Dec. 6, 1995

[30] Foreign Application Priority Data

Dec. 20, 1994 [EP] European Pat. Off. ..... 94810739
May 23, 1995 [EP] European Pat. Off. ..... 95810338

[51] Int. Cl.[6] ..... G04B 37/00; B65D 81/26

[52] U.S. Cl. ..... 368/276; 368/291; 206/204

[58] Field of Search ..... 368/10, 276, 280, 368/286, 291–292; 206/204

[56] References Cited

U.S. PATENT DOCUMENTS

| | | | |
|---|---|---|---|
| 2,463,315 | 3/1949 | Rosen et al. . | |
| 3,567,085 | 3/1971 | Flores . | |
| 3,750,387 | 8/1973 | Piquere | 368/286 |
| 3,939,646 | 2/1976 | Uchiyama . | |

FOREIGN PATENT DOCUMENTS

| | | |
|---|---|---|
| 0290920 | 11/1988 | European Pat. Off. . |
| 215706 | 10/1941 | France . |
| 1090874 | 4/1955 | France . |
| 551860 | 11/1956 | France . |
| 58-061561 | 4/1983 | Japan . |
| 314386 | 7/1956 | Switzerland . |
| 384690 | 2/1965 | Switzerland . |

*Primary Examiner*—Vit W. Miska
*Attorney, Agent, or Firm*—Jacobson, Price, Holman & Stern, PLLC

[57] ABSTRACT

Desiccation capsule (20) for the interior (32) of an article comprising a first compartment (27) containing a desiccant (30). One wall (22) of the first compartment is perforated by a first opening (25) obturated by a semi-permeable membrane or a filter (23). The moisture on the interior of the article flows through this membrane and is absorbed by the desiccant.

One of the walls (29) of the first compartment is transparent and permits the user of the article protected by the capsule to observe any change of colour or of appearance of the desiccant following the absorption of moisture. The capsule can then be withdrawn thanks to non-permanent fastening means (36) of screw or clip type and replaced by a new capsule. It is also possible to reuse the same capsule by heating the desiccant. A stopper (41) permits transport and stocking of the capsule prior to use.

12 Claims, 3 Drawing Sheets

DESICCATION CAPSULE AND ARTICLE PROVIDED WITH SAID CAPSULE

This invention concerns a desiccation capsule having a compartment intended to contain a desiccant able to absorb moisture, the said compartment being provided on one of its sides with a first opening obturated by a membrane allowing moisture to flow through but retaining the desiccant non-dissolved. This invention also concerns articles, such as watches, apparatus for transmission and/or reproduction of images, packaging means, etc., having a case defining the interior and the exterior of the article whose interior must be protected from moisture.

An increasing number of articles and devices need to be protected continuously from damage due to moisture. This is the case in particular for electronic apparatus, especially portable ones, such as watches, calculators, computers, photocopiers, recording devices, apparatus for transmission and/or reproduction of sound and images, for example photographic equipment, cameras, video cameras, video cassette recorders, telephones, portable music players, radios, amplifiers, etc. It is also the case for a lot of mechanical devices, for example certain watches or certain musical instruments, electrical apparatus such as motors, illuminating devices, control boxes as well as optical devices such as binoculars or lenses. This also applies to articles consisting of packaging means with sensitive parts, for example cardboard for packaging or cases for transport of any kind of object sensitive to moisture. In a general way, the invention can be applied to practically all articles having a case defining the interior and the exterior of the article where the interior of the article or the object disposed inside the article would suffer damage from moisture.

One technique sometimes used to protect the inside of an article consists in rendering the case as fluid-tight as possible. This technique is suitable above all for articles which do not have to be opened very often, for example watch-cases. It has nevertheless also been used to protect portable music players or binoculars or apparatus for transmission and/or reproduction of images, especially photo cameras or film cameras, for example.

Despite the progress made in the technology of tightness and in particular the progress in the technology of gaskets, it is difficult to ensure really secure and lasting protection of the interior of the case of a device or of an article from damage due to moisture, especially from corrosion. Gaskets in fact have problems of ageing and lose part of their tightness after some years. On the other hand, tightness can be accidentally altered following an impact, for example.

Even though they require protection, certain articles can only be rendered fluid-tight with great difficulty, or at a cost out of proportion to the value of the article to be protected. These articles must then be protected by keeping them constantly in an environment low in moisture, which proves to be difficult. This is the case with cardboard used for storage or for transport of sensitive objects and for the majority of common electronic devices.

Swiss patent CH 215706 (19 April 1940) describes a fluid-tight watch whose case contains a desiccation capsule. This capsule contains a desiccant able to absorb the moisture which has been able to penetrate into the watch. The desiccation capsule permits protection of the mechanism of the watch even when the tightness of the gaskets turns out to be weakening.

U.S. Pat. No. 2,463,315 (1 March 1949), CH 384690 (31 December 1956), U.S. Pat. No. 3,939,646 (24 February 1976), and JP 58061561 (12 April 1983) describe different other means of placing a certain quantity of desiccant inside the case of a watch, demonstrating well that research efforts have been directed for a long time toward a solution to this problem. None of these solutions has proved vital owing to the drawbacks which have prevented any commercial success.

In fact none of these solutions permits easy detection of whether moisture has penetrated an article or whether the capsule has to be replaced. If the tightness of the case has become defective, so that water penetrates easily into the watch, the capsule can only fulfil its function as long as its capacity to absorb has not been exceeded. The capsule must therefore be replaced or regenerated, for example by heating, where possible before this point has been reached. However, in these prior art inventions nothing permits detecting the moment when the capsule has to be regenerated. Moreover, regeneration or replacement in all these prior art inventions requires disassembly of the case and must therefore be carried out by a specialist.

Swiss patent CH 314386 (22 December 1953) describes a fluid-tight watch having a pellet containing a material sensitive to moisture. The pellet is visible from the outside and a change in the colour or in the appearance of the material thus indicates to the user of the watch that moisture has penetrated the case. However, this pellet works solely as an indicator but not as a desiccant, and does not have the function of absorbing moisture. When the pellet changes colour, it is therefore necessary to repair the watch, which can already have been subjected to damage of a possibly irreparable kind.

Thus one of the objects of the invention is to propose a desiccation capsule which avoids these drawbacks, and which clearly indicates to the user the moment when it must be replaced.

Another object is to propose a simple and economical construction for the desiccation capsule which is at the same time efficient and which can be adapted to diverse kinds of articles with possibly very different internal volumes.

To achieve this, the invention proposes making a desiccation capsule having one transparent wall permitting the colour and/or appearance of the desiccant contained in the capsule to be seen from the outside, the capsule then being easily taken off thanks to its non-permanent fastening means.

Preferably used therefore as a desiccant is a substance which changes colour in the course of absorption of moisture, for example, $CuSO_4$. Thus avoided are some of the problems entailed with the desiccants used in the prior art inventions mentioned, desiccants of the type $SiO_2$, which have a relatively weak volumetric capacity to absorb moisture, which results in desiccation capsules of large dimensions, making it very difficult to integrate them in an aesthetic way in certain articles, especially in a watchcase. In addition, the variation in the colour of $SiO_2$ in the course of absorption of moisture is weak, which in fact makes it a very poor visual detector of moisture.

The problems mentioned are thus resolved thanks to the novel features of claim 1.

The majority of common desiccants are corrosive and attack the metallic capsule which contains them. In the prior art devices mentioned, these desiccants are at best separated from the interior of the case of the device by at best one semi-permeable membrane which, in the normal situation, retains the desiccant, but allows moisture to pass in liquid or gaseous form. When the moisture penetrates into the case, this moisture traverses the semi-permeable membrane and is absorbed by the desiccant. Unfortunately, the desiccant dissolves itself in water and manages in this way to cross back over the membrane in the opposite direction. Traces of the desiccant thus leave the capsule and spread into the interior of the case of the article, attacking the mechanism, by way of corrosion, and creating points of location of moisture. This problem is particularly great when a desiccation capsule of small diameter is used to desiccate quickly a volume of very humid air. In this situation the semi-permeable membrane, having a small surface, becomes totally impregnated with water and remains humid at least until the moment when all the water has been absorbed by the desiccant.

According to one feature of the invention, the desiccation capsule has a first compartment, containing the desiccant, and a second compartment separated from the first by a semi-permeable membrane and equipped with a second opening connecting it to the interior of the article. This second compartment acts as a flooding chamber which retains the dissolved desiccant inside and prevents it from spreading into the entire case of the article or device to be protected.

According to another feature of the invention, the capsule can be provided with a removable stopper obstructing the second opening. This stopper permits transport and stocking of the desiccation capsule prior to its installation in the article to be protected. The stopper is withdrawn preferably just before installation of the capsule in the case of the article.

The invention also concerns articles which can be protected by desiccation capsules of this kind.

The invention will be described more closely in the following with reference to the accompanying figures where:

Figure 1:
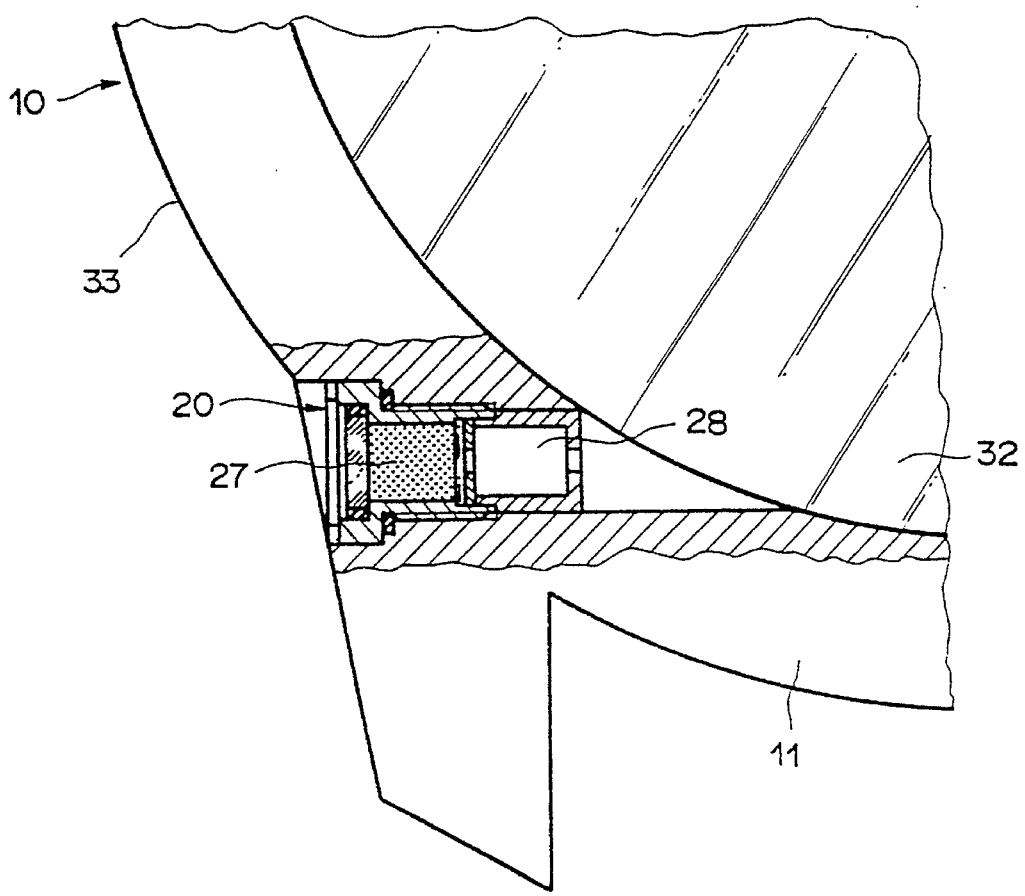
FIG. 1 shows a first type of desiccation capsule particularly adapted to the middle of a watchcase.

FIG. 1 shows a first type of desiccation capsule 20, especially adapted to be integrated into the middle 11 of a watch 10. The capsule comprises a first compartment 27 containing copper (II) sulphate $CuSO_4$ as a desiccant 30. Besides a capacity to absorb a large volume of moisture, which allows a miniaturization of the capsule, $CuSO_4$ has the advantage of changing quickly from white to bright blue when it comes into contact with moisture. It thus makes an efficient visual detector of moisture. It can be used in powder, crystal or pellet form or as a conglomerate, for example. The first compartment has a volume sufficient to contain enough desiccant to be able to absorb all the moisture able to penetrate into the watch.

Figure 2:
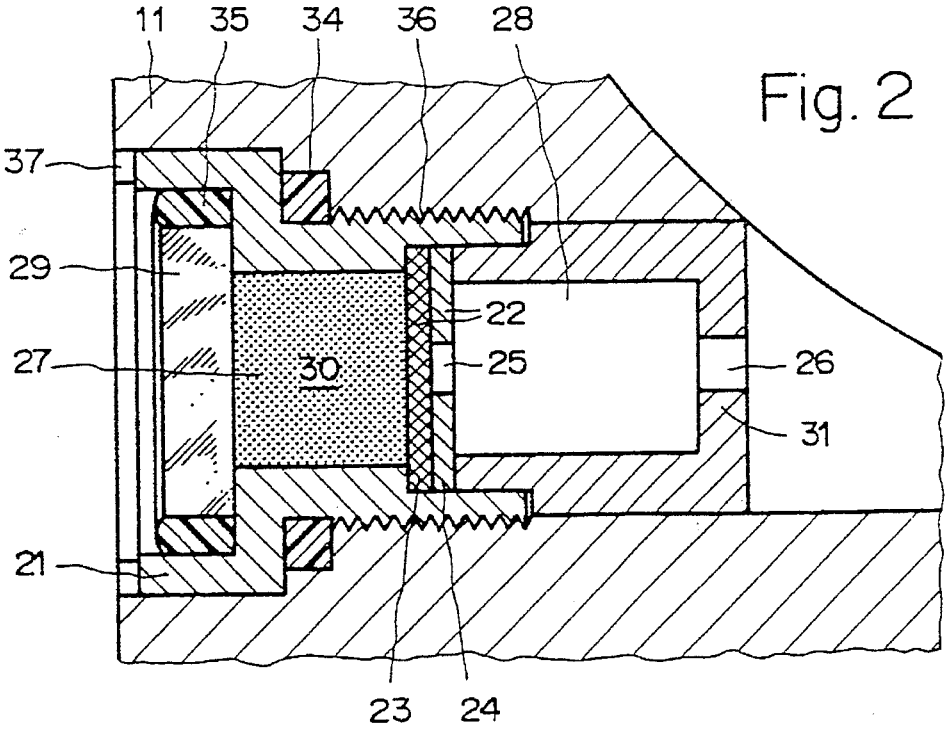
FIG. 2 shows in detail a desiccation capsule of the first type.

At least certain parts 21, visible in FIG. 2, of the capsule, which are in contact with the desiccant, are preferably made of titanium. This metal has the advantage of being highly resistant to corrosion from the desiccant and its implementation has been well mastered in horology.

According to the invention, the capsule has a second compartment 28 functioning as a flooding chamber. Referring to FIG. 2, the first compartment 27 and the second compartment 28 are separated by an internal wall 22 composed of a membrane 23 and of a washer 24 pierced by an opening 25. The internal wall 22 forms one of the sides of the first and of the second compartment. Conclusive tests have been carried out with a wall having a diameter of 1.8 millimetres and a diameter for the opening of 0.5 millimetres. The washer 24 permits prevention of a tearing of the membrane when the desiccant expands in volume in the course of absorbing moisture. In an embodiment not shown, this washer can be omitted, for example by using a desiccant which expands less. The internal wall would then be formed solely by a membrane. The membrane could be, for example, of the semi-permeable type or could be made using a porous filter such as is common in the chemical industry. In one variation, the membrane could also be a ceramic membrane or any other membrane or filter able to allow moisture to pass through while completely retaining the desiccant. The second compartment is preferably likewise made of titanium.

The second compartment 28 is connected to the interior 32 of the watch by a second opening 26 through a second wall 31 forming another side of the second compartment. In this variant embodiment, the second opening has a relatively small diameter with respect to the size of the second wall, preferably less than one millimetre. The second opening is preferably circular, but it could just as well have any other form. In this first example embodiment, the second wall 31 is more or less parallel to the first wall 22 and the two openings are more or less aligned.

The desiccant is visible from the exterior 33 of the watchcase through a transparent wall 29 made, for example, of sapphire glass. A gasket 35 ensures tightness around the glass. In this example, the transparent wall is more or less parallel to the first wall 22 and to the second wall 31. Through this transparent wall the user of the watch can observe any possible changes in the colour of the desiccant and thus detect if moisture has penetrated into the watchcase.

According to the invention, the capsule is detachable and the first compartment can be separated from the second. The first compartment is then replaceable and can be exchanged, for example, when a change of colour of the desiccant has been detected. To do this, one part at least on one part of the exterior of the capsule is provided with a threading 36. The first compartment is thus screwed into the middle of the watchcase. A circular gasket 34 ensures tightness with respect to the threading. The second compartment 28 is integral with the middle of the watchcase and is not replaceable. In a variant embodiment not shown, the capsule is not detachable and the second compartment is integral with the first. In this case, it is the whole capsule which can be substituted, which permits getting rid of traces of desiccant which might still be found in the second compartment. The first compartment, or in the variant embodiment the whole capsule, can be replaced by a new one, or can be recycled by heating which permits carrying off any water absorbed by the $CuSO_4$.

Figure 3:
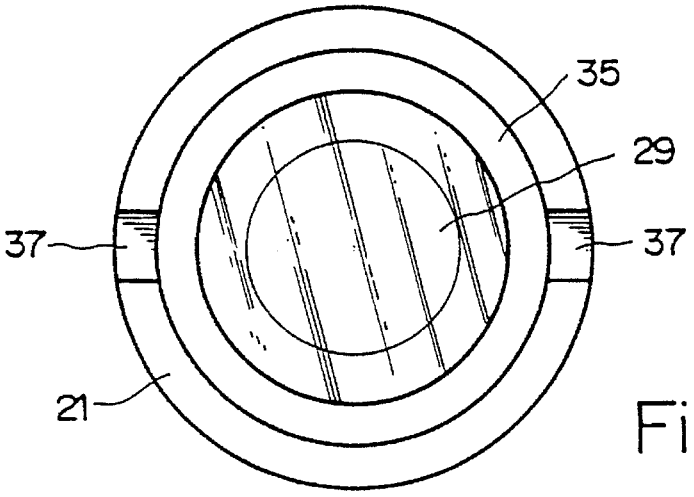
FIG. 3 shows another view of the desiccation capsule of the first type.

FIG. 3 shows another view of the capsule from the exterior. A groove 37 is foreseen to permit replacement, using a screwdriver, of the first compartment 27 in the first embodiment, or of the whole capsule in the variant embodiment. This construction permits realization of a capsule which penetrates completely into the opening of the case in such a way that the head of the capsule reaches just flush with, or slightly set back from, the surface of the case. Other arrangements for easy replacement of the whole or of part of the capsule, which can be fastened to the middle of the watchcase other than by screwing, are within the capacity of one skilled in the art.

The invention thus allows easy replacement of the desiccation capsule without opening the case of the watch. This operation can thus be carried out very simply by an inexperienced user and without risk of damage to the gaskets which ensure tightness of the watch.

The functioning of the invention will now be explained.

Moisture inside the watch penetrates into the second compartment of the capsule through the opening 26 of small diameter. Owing to adhesive forces which attract the molecules of water toward the metal of the capsule, a film of water forms which clings to the walls of the opening and obstructs it completely. This film thus forms a liquid wall stretching over the opening 26. The atmospheric pressure in the second compartment repels this film and maintains it against the opening.

Water in liquid form is thus prevented from penetrating into the capsule. The water which impregnates the semi-permeable membrane 22, which may contain traces of desiccant, is separated from the moisture inside the case of the watch or of the article by the volume of air contained in the second compartment. In the prior art capsules, which are not provided with this flooding chamber, this water can expand inside the case and the desiccant can disperse itself throughout the watch.

The transfer of water through the second compartment takes place by transport of gaseous particles only. These particles are the result of evaporation of the film of water stretching over the opening 26. The evaporation is facilitated, on the one hand, by the body heat of the wearer of the watch, and, on the other hand, by the attraction of the desiccant which absorbs the gaseous particles which have passed through the membrane 23, tending to desiccate the atmosphere in the second compartment and thus to favour the passage of water particles of the film from the liquid state into the gaseous state.

The film remains stretched over opening 26 as long as it is supplied with water from the interior of the watch.

It is to be noted that the second opening 26 could have a shape other than circular, for example square or polygonal. The same holds true for the second compartment.

Figure 4:
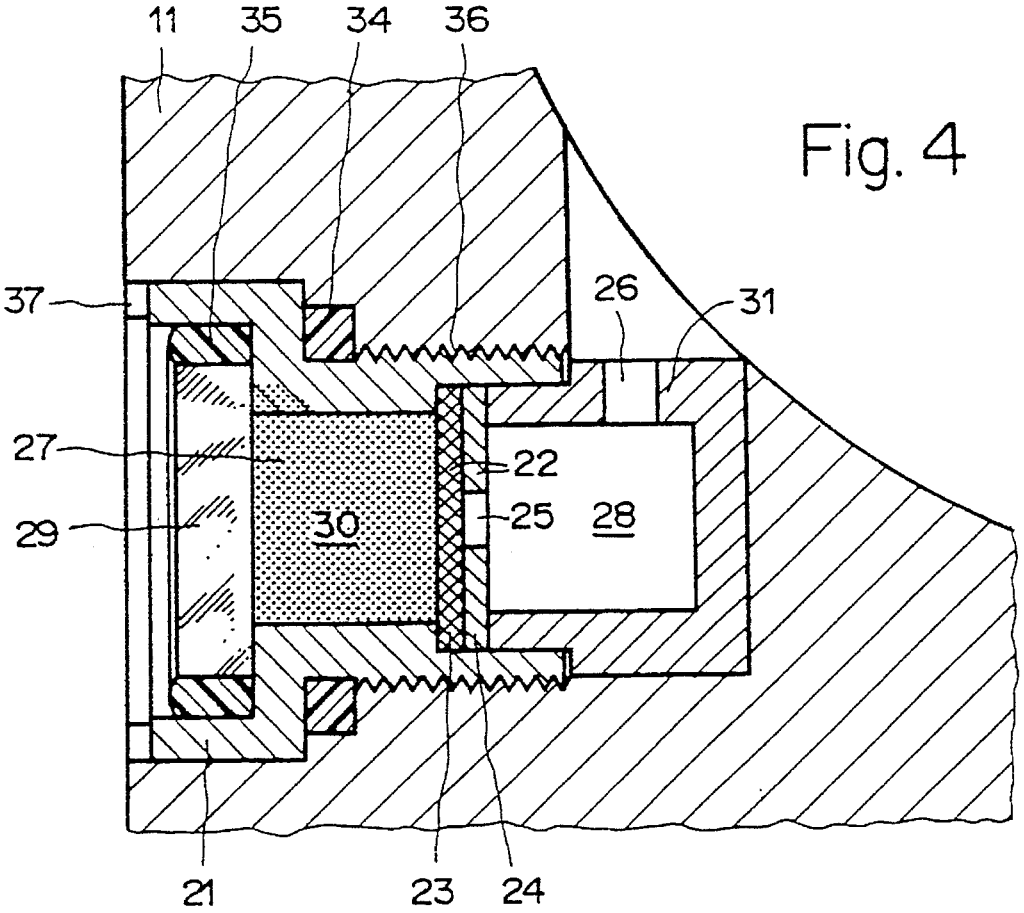
FIG. 4 shows a second type of desiccation capsule particularly adapted to the middle of a watchcase.

FIG. 4 shows another embodiment of the desiccation capsule. In this embodiment, the axis of the second opening 26, which connects the second compartment 28 to the interior 32 of the watch, is more or less perpendicular to the axis of the first opening 25. With respect to the first embodiment, this one permits miniaturization of the capsule for a watch having a middle of small dimension. In this embodiment, the second compartment is not replaceable.

In another embodiment, not shown in the figures, the desiccant is visible from the outside through a transparent wall which is not parallel to the first wall 22. In this case, at least a part of the lateral walls of the capsule, made of sapphire glass, is visible from the exterior of the watch.

The capsule could be integrated into other parts of the middle of the watch than that shown, or even in the back or in the dial of the watch. It is of course also possible to integrate a desiccation capsule of one of the types described in articles other than watches, possibly by adapting the volume of the desiccant and thus the dimensions of the capsule to the internal volume of the article to be protected.

Figure 5:
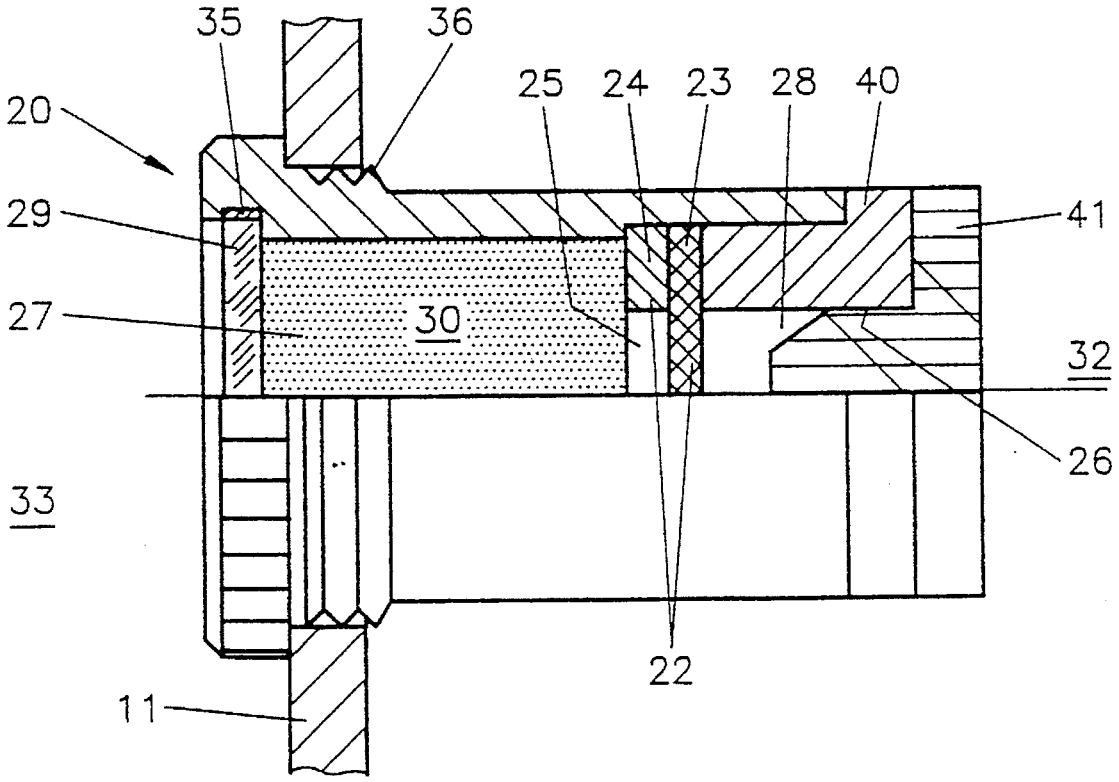
FIG. 5 shows a third type of desiccation capsule particularly adapted to articles having very large internal volumes.

FIG. 5 depicts another embodiment of the desiccation capsule according to the invention. This embodiment is very particularly adapted to articles to be protected of larger internal volume. The dimensions of the capsule are therefore much bigger, for example on the order of 12 mm in diameter and 25 mm in length. The first compartment 27 is thus able to contain a larger quantity of desiccant 30, capable of absorbing the moisture which can penetrate into an article of greater volume than a watch.

The capsule 20 is preferably made of synthetic or composite material, for example polyacetal. It can however also be made of metal, preferably titanium in order to resist corrosion due to the desiccant.

The second compartment 28 is separated from the first by an internal wall 22 composed of a membrane 23 and of a washer 24, pierced by a first opening 25. A driven-in fitting 40 holds this wall 22 in place. To facilitate disassembly and replacement of the desiccant 30 or of the membrane 23, the fitting 40 can also be screwed, rather than driven, in the second compartment 28.

The second opening 26 through the fitting 40 permits connecting the second compartment 28 with the interior 32 of the article to be protected from moisture. In FIG. 5 this opening is obstructed by a stopper 41, which is withdrawn after the capsule has been put in place, as will be seen later on. As in the embodiments corresponding to the preceding figures, the moisture thus passes through the second opening 26, then the second compartment 28, before crossing the first opening 25 and the membrane 23 to be absorbed by the desiccant 30 in the first compartment 27.

The dimensions of the capsule 20 are, in this example, much bigger than than in the preceding examples. Consequently the first opening 25 likewise has a larger diameter. The capsule 20 is thus adapted to articles of larger volume than that of a watch, for example camera cases. The case of this type of article is generally not tight and must be kept sheltered from moisture. In the case of complete immersion of the article, the article is generally damaged irreparably, regardless of the presence of a desiccation capsule.

The desiccation capsule 20 is nevertheless used in this type of article to reduce the degree of moisture in the air inside the case in order to prolong the life of the article. The amounts of moisture which the capsule must absorb are thus generally low, at least compared to the amounts of moisture which can prevail in a watch immersed in water with failing sealing gaskets.

The semi-permeable membrane 23 having a large surface and the amount of moisture to be absorbed being usually low, it is not very likely that the semi-permeable membrane 23 would become completely saturated with water and that some of the desiccant could pass through the membrane and expand inside the device. It is thus not usually necessary for the second opening 26 to have a small diameter as in the preceding embodiments. The lateral walls of the second compartment 28 however allow collection above all of the traces of desiccant which all the same could accidentally pass through the membrane.

In the embodiment illustrated, this second opening 26 has a relatively large diameter, equal to the diameter of the first opening 25 and of the second compartment 28.

The desiccation capsule 20 can be fixed to the case 10 of the article to be protected from moisture by non-permanent fastening means, for example by means of a thread 36 corresponding to a threading in one opening of the case. The capsule can be easily unscrewed and replaced when the user detects through the transparent wall 29 a change in colour and/or appearance of the desiccant 30. The capsule can be unscrewed as above using a screwdriver engaged in a groove on the head of the capsule, or manually by taking advantage of a ribbed surface on the periphery of the head. In a special embodiment adapted to a capsule made of plastic, the capsule can be fixed to the case by clip means of a type known per se, taking advantage of the elasticity of the material. A peripheral sealing gasket is not necessary in the case where this type of capsule is used with articles whose case is not tight anyway, for example conventional photo cameras. Depending upon the material of the case of the article to be protected, for example whether it is of cardboard or of soft plastic, the capsule can also be directly pushed in forcibly, possibly through a pre-cut opening. The capsule can be withdrawn and exchanged without opening the case.

The window pane 29, consisting of the transparent wall through which the user can observe the desiccant 30, is made of mineral glass or possibly of plexiglass, which can then be fixed directly in the capsule by driving it in. A gasket 35 protects the desiccant 30 from the moisture outside the case of the article.

Before it has been put in place in the case of the article to be protected, the desiccation capsule is provided with a stopper 41. This stopper permits preventing the desiccant from absorbing moisture and thus from becoming saturated before installation of the desiccation capsule. This stopper is preferably made of synthetic material, for example of NBR or of nitrile, but could also be a stopper of cork. Thanks to the stopper, which is inserted in opening 26, it is possible to stock, transport and market the desiccation capsule independently of the article to be protected. It is likewise possible to adapt a stopper, of much smaller diameter, to the opening 26 of the preceding embodiments of the desiccation capsule.

The article to be protected from moisture, as has been seen, can vary greatly in its construction and its use, but generally has a case 11 defining the interior and the exterior of the article. This case can, depending upon the situation, be completely tight or only offer limited protection for example from splashing or splattering of liquid. The interior of the case, which contains for example an electronic, mechanical or optical mechanism, is thus more or less protected from moisture. An opening is foreseen in the case 11 of the article, adapted for removably fastening there a desiccation capsule 20. The opening is provided with a threading in the case where the capsule screws in. The diameter of the opening must be sufficient to introduce therein a desiccation capsule adapted to the internal volume of the article to be protected, and to allow the changes in colour of the desiccant to be seen clearly through the transparent wall 29 which must therefore be of sufficient diameter. If, unlike in FIGS. 1 to 4, the desiccation capsule 20 cannot be entirely contained in the volume of the opening, a certain place must be reserved inside case 11 to introduce the capsule there. The opening is foreseen at a location in the case permitting the user to verify easily whether the desiccation capsule must be replaced, and if so, to remove it completely for replacement or regeneration, by using a screwdriver, if necessary. If the article to be protected has a tight case allowing immersion, the opening for the capsule must then have a seal or at least a groove or a place to put a gasket.

The article to be protected is preferably designed so that the transparent wall 29 of the desiccation capsule 20, when put in place, is visible from the outside. Said transparent wall is preferably flush with the surface of the case when the capsule is in place, as in FIGS. 1 to 4. In certain types of articles, however, this transparent wall can be visible upon opening the case of the article or through a window in the case of the article. If the article is an optical device, for example a photo camera, a video camera or a pair of binoculars, the capsule can also be placed inside the case in such a way that the transparent wall 29 is visible only through the view finder of the device in the form of an alarm signal indicating to the user the need to replace the desiccation capsule.

What is claimed is:

1. A desiccation capsule comprising:

a first compartment, said first compartment being intended to contain a desiccant able to absorb moisture, the said first compartment including a plurality of faces among which is a first face provided with a first opening, the said first compartment being closed on at least one of the said faces by a transparent wall allowing the color of the said dessicant to be seen, a membrane allowing moisture to flow through but retaining the non-dissolved desiccant, the said membrane obturating the said first opening, a second compartment linked to the said first compartment by the said first opening, the said second compartment including a second face, said second face being provided with a second opening, non-permanent fastening means permitting the said capsule to be fastened in a removable way to an article to be protected from moisture.

2. The desiccation capsule of claim 1, wherein the non-permanent fastening means are of the type with a threading on the outside periphery of the capsule.

3. The desiccation capsule of claim 1, wherein the non-permanent fastening means are of the clip fastening type.

4. The desiccation capsule of claim 1, further comprising a peripheral gasket preventing water from penetrating into the article to be protected from moisture.

5. The desiccation capsule of claim 4, wherein the second opening is of relatively small size compared to the size of the second face.

6. The desiccation capsule of claim 5, wherein the diameter of the second opening is less than 1 mm.

7. The desiccation capsule of claim 4, wherein the first compartment is removable and can be separated from the rest of the capsule.

8. The desiccation capsule of claim 1, further comprising a removable stopper blocking the said second opening.

9. An article having a case defining the interior and the exterior of the article, the said case comprising at least one opening adapted for removably fastening there a desiccation capsule according to claim 2 with the said first opening on the interior of the article and the said transparent wall on the exterior of the article.

10. The article according to claim 9, wherein it is a watch.

11. An article having a case defining the interior and the exterior of the article, said case having at least one opening adapted for removably fixing there a desiccation capsule according to claim 3 with the said first opening on the interior of the article and the said transparent wall on the exterior of the article.

12. Use of a desiccation capsule according to claim 1 for protecting the interior of an article having a case defining the interior and the exterior of the article.

* * * * *